US005558514A

United States Patent [19]

Ansquer

[11] Patent Number: 5,558,514

[45] Date of Patent: Sep. 24, 1996

[54] SAFETY LATCH FOR A LIGHTER

[75] Inventor: Henri Ansquer, Quimper, France

[73] Assignee: Hameur Et Cie, Paris, France

[21] Appl. No.: 450,026

[22] Filed: May 25, 1995

[30] Foreign Application Priority Data

May 27, 1994 [FR] France ..... 94 06452

[51] Int. Cl.[6] ..... F23D 11/36

[52] U.S. Cl. ..... 431/153; 431/255

[58] Field of Search ..... 431/153, 277, 431/255; 222/153

[56] References Cited

U.S. PATENT DOCUMENTS

| | | |
|---|---|---|
| 1,895,032 | 1/1933 | Fisher . |
| 2,520,328 | 8/1950 | Nissen . |
| 2,727,376 | 12/1955 | Felt . |
| 3,169,672 | 2/1965 | Soffer et al. . |
| 3,859,035 | 1/1975 | Schlamp . |
| 3,924,782 | 12/1975 | Starrett . |
| 3,938,943 | 2/1976 | Malamoud . |
| 3,961,876 | 6/1976 | Chernock . |
| 4,024,988 | 5/1977 | Starrett . |
| 4,028,043 | 6/1977 | Neyret . |
| 4,049,370 | 9/1977 | Neyret . |
| 4,157,891 | 6/1979 | Moriya . |
| 4,243,377 | 1/1981 | Schmid . |
| 4,295,819 | 10/1981 | Sugiyama . |
| 4,332,549 | 6/1982 | Fuller . |
| 4,403,945 | 9/1983 | Letgib . |
| 4,432,542 | 2/1984 | Poynter . |
| 4,471,404 | 1/1985 | Nitta . |
| 4,496,309 | 5/1985 | Schachter . |
| 4,516,933 | 12/1985 | Buzzi . |
| 4,560,345 | 2/1986 | Schachter . |
| 4,569,654 | 6/1986 | Borghesi . |
| 4,595,352 | 1/1988 | Endelson . |
| 4,717,335 | 7/1988 | Loveless . |
| 4,758,152 | 9/1988 | Kordecki . |
| 4,773,849 | 11/1988 | Schacter . |

(List continued on next page.)

FOREIGN PATENT DOCUMENTS

| | | |
|---|---|---|
| 1145658 | 5/1983 | Canada . |
| 285748 | 10/1988 | European Pat. Off. . |
| 296281 | 12/1988 | European Pat. Off. . |
| 312627 | 4/1989 | European Pat. Off. . |
| 2220047 | 9/1974 | France . |
| 2280029 | 2/1976 | France . |
| 2465161 | 3/1981 | France . |
| 2568838 | 5/1981 | France . |
| 2633702 | 7/1988 | France . |
| 3040596 | 5/1981 | Germany . |
| 5685638 | 7/1981 | Japan . |
| 5632749 | 8/1987 | Japan . |
| 636943 | 6/1983 | Switzerland . |
| 2062200 | 5/1981 | United Kingdom . |
| 2072820 | 7/1981 | United Kingdom . |
| 8100752 | 3/1981 | WIPO . |

OTHER PUBLICATIONS

Certificate of Accuracy for French Patent Publication No. 2,220,047 (No Date).

Certificate of Accuracy for French Patent Publication No. 2,280,029 (No Date).

Certificate of Accuracy for French Patent Publication No. 2,465,161 (No Date).

Certificate of Accuracy for WIPO Patent Publication No. 8,100,752 (No Date).

*Primary Examiner*—Carl D. Price

*Attorney, Agent, or Firm*—Morgan & Finnegan, L.L.P.

[57] ABSTRACT

A safety device comprising a locking mechanism for a gas lighter. A latch is fixed beneath the pushbutton and it comprises an upside-down U-shaped resilient portion occupying a vertical plane. The bottom end of the U-Shape is closed by an arm carrying retractable stops. In the locked position, the stops prevent the pushbutton from moving downwards and consequently prevent gas escaping from the lighter. The invention applies to increasing safety, particularly when children are concerned.

10 Claims, 4 Drawing Sheets

U.S. PATENT DOCUMENTS 4,784,601 11/1988 Nitta .
4,784,602 11/1988 Nitta .
4,786,248 11/1989 Nitta .
4,799,877 1/1989 Bisbee .
4,822,276 4/1989 Bisbee .
4,830,603 5/1989 Cirami ..... 431/153
4,832,596 5/1989 Morris, Sr. .
4,850,854 7/1989 Buck .
4,859,172 8/1989 Nitta .
4,869,662 9/1989 LeCourt et al. .
4,869,663 9/1989 Fremund .
4,878,836 11/1989 Nitta .
4,884,965 12/1989 Nitta .
4,889,482 12/1989 Schachter .
4,904,180 2/1990 Nitta .
4,921,420 5/1990 Johnson .
4,992,042 2/1991 Kneupfer .
5,002,482 3/1991 Fairbanks et al. .
5,184,948 2/1993 Iwahori .
5,205,729 4/1993 Iwahori ..... 431/153
5,213,493 5/1993 Iwahori .
5,224,854 7/1993 Ansquer .
5,242,297 9/1993 Cirami ..... 431/153
5,334,011 8/1994 Frigiere ..... 431/153
5,378,143 1/1995 Ansquer ..... 431/153

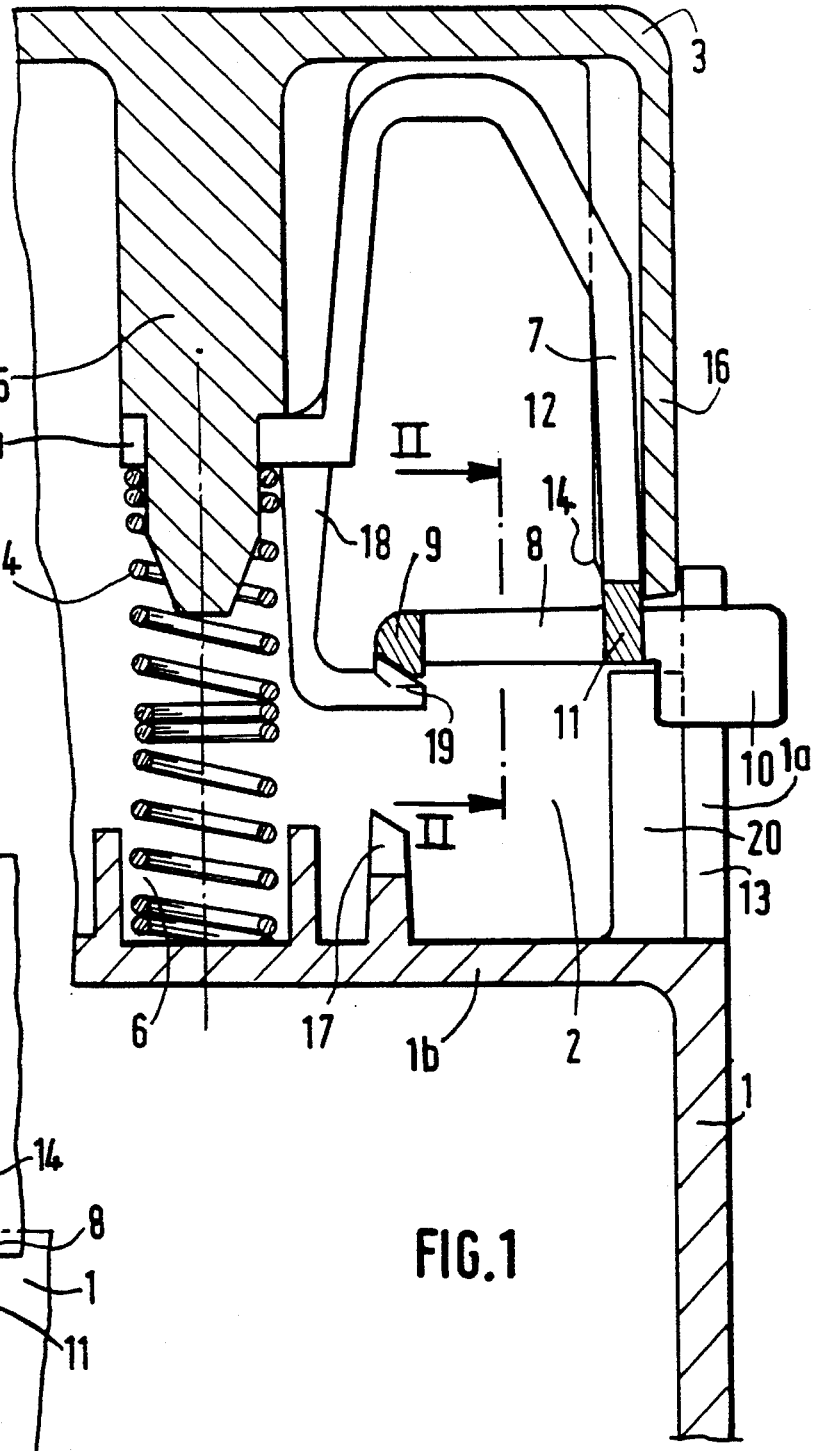
FIG.1
FIG.2
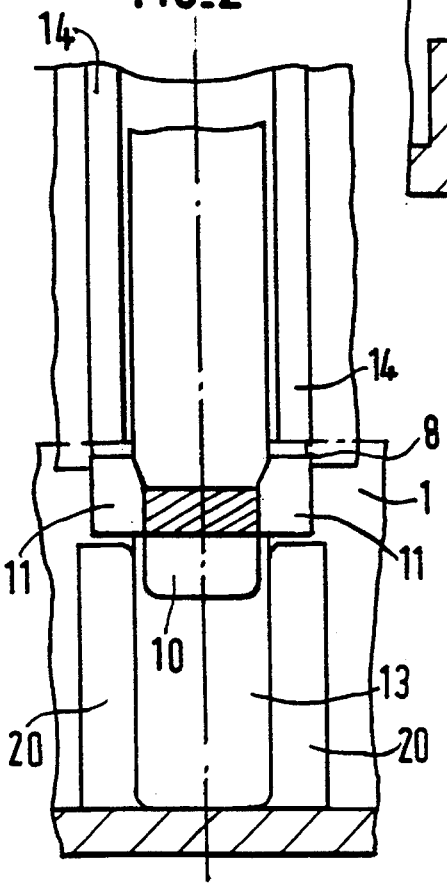

SAFETY LATCH FOR A LIGHTER

This application is related to U.S. patent application Ser. No. 08/218,506 filed Mar. 25, 1994, U.S. Pat. No. 5,472,338.

FIELD OF THE INVENTION

The present invention relates to a safety device for locking the pushbutton of a lighter so that it becomes practically impossible for it to be ignited accidentally or ignited by children.

BACKGROUND OF THE INVENTION

Lighters, in particular disposable lighters, are known that comprise a hollow body containing a tank of liquefied combustible gas, an expander mounted on an outlet of the tank, and a burner provided with a valve above the expander, together with means for igniting the gas escaping from the burner after the valve has been opened. The ignition means are generally constituted by a flintwheel bearing against a flint, rotation of the flintwheel producing sparks that are directed over the burner. Another solution that is becoming more and more widespread consists in replacing the assembly of flint and flintwheel by a piezoelectric igniter. In both cases, the gas of the lighter is ignited by pressing on a pushbutton which is either mounted to pivot on the body of the lighter or else to slide relative thereto. As it moves, the pushbutton causes the burner to be displaced, thereby releasing the gas to be set alight.

The pushbutton is pressed by the user of the lighter. However, it can happen that it is pressed accidentally, e.g. in a pocket, or by an unauthorized "user" who might misuse the lighter.

In order to mitigate that drawback, proposals have already been made to provide pushbutton locking means. When the pushbutton is locked, gas cannot escape from the tank so no ignition is possible. That is the locked or safety position.

However, in order to be able to use the lighter, the pushbutton must be capable of being unlocked without unlocking requiring any special skill. That is why it is necessary to have a cocked or "pre-ignition" position in which the lighter is ready to operate merely by pressing on the pushbutton as in usual operation.

FR-A-2 633 702 describes a lighter provided with locking means in which there exists a locked position of the pushbutton and a stable "cocked" or unlocked position enabling the lighter to be ignited in conventional manner. Starting from the locked position, the safety mechanism is initially unlocked. After it has been unlocked, the user can ignite the lighter at will. That disposition avoids the need to perform two movements simultaneously: unlocking and igniting. Depressing the pushbutton returns the locking mechanism automatically to its locked position.

OBJECTS AND SUMMARY OF THE INVENTION

An object of the present invention is to provide a lighter safety device of the above type which provides operating safety, particularly where children are concerned, but which is simpler to operate and of reduced cost.

In the locking mechanism of the invention for the pushbutton of a lighter, where the lighter comprises a body, a spring-biased pushbutton which is pivotally or vertically movable relative to the body, the rear portion of the pushbutton having a downwardly-extending skirt, and skirt-blocking means, a latch is secured to and mounted beneath the pushbutton, the latch being constituted by a resilient piece mounted substantially in the plane of symmetry of the lighter and having a depressible safety catch that projects relative to the lighter body when the lighter is in the locked position.

According to another characteristic of the invention, the latch includes an arm perpendicular to the displacement direction of the pushbutton, the arm carrying the depressible safety catch at one of its ends and carrying a projecting portion at its other and for the purpose of co-operating with a hook that is carried by the latch.

BRIEF DESCRIPTION OF THE DRAWINGS

Other characteristics and advantages of the invention appear from the following description of particular embodiments, given solely as non-limiting examples and described with reference to the drawings, in which:

FIG. 1 is a vertical section view through the rear top portion of a lighter provided with a locking mechanism of the invention, shown in the locked position;

FIG. 2 is a fragmentary section on line II—II of FIG. 1;

DETAILED DESCRIPTION

Figure 3:
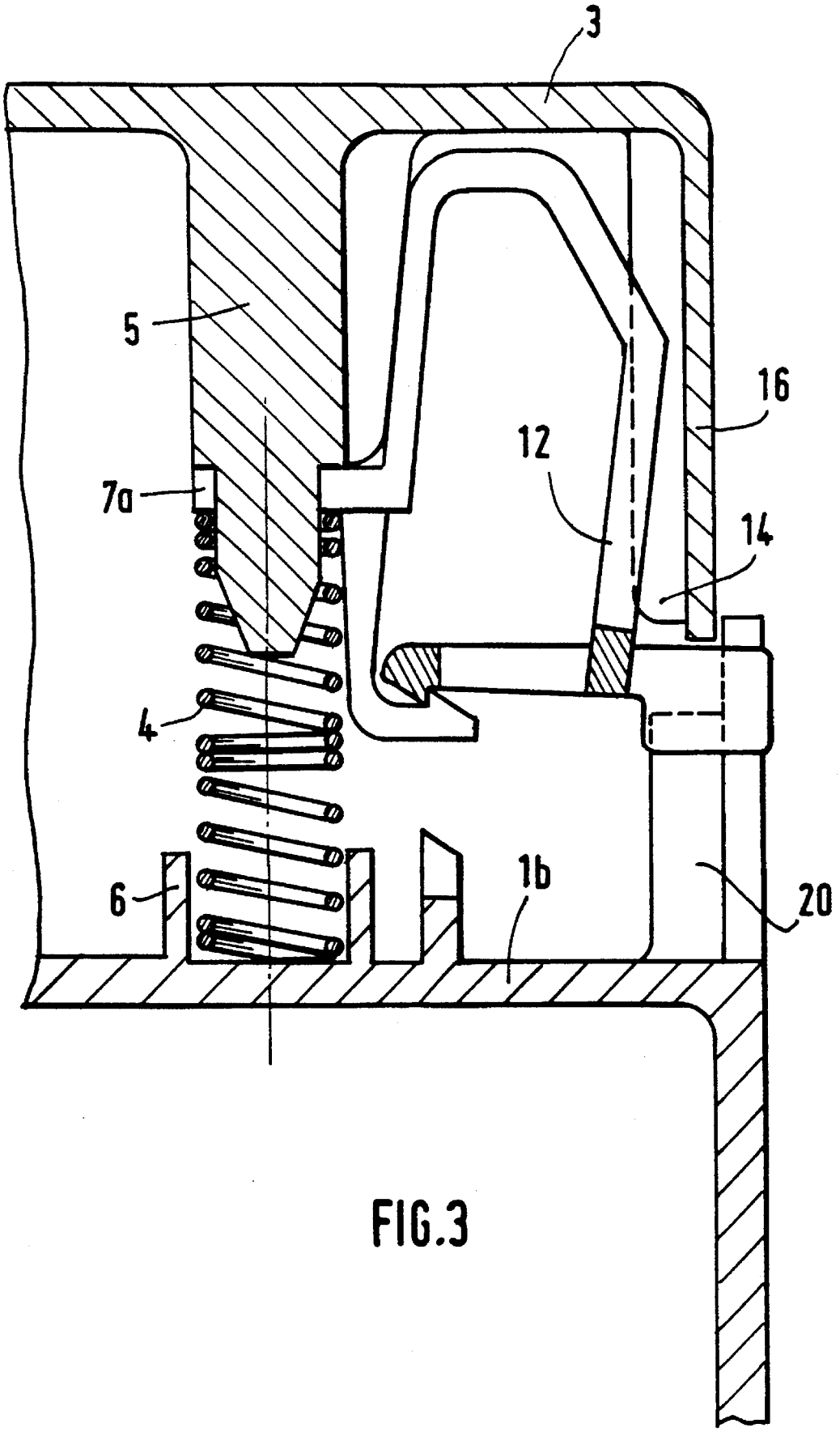
FIG. 3 is similar to FIG. 1 and shows the unlocked or "cocked" position prior to ignition.

FIG. 1 is a vertical section view showing the rear top portion of a lighter body 1 that forms a cavity 2 within which the pushbutton 3 can move, which cavity is defined towards the back of the lighter by a vertical wall 1*a* and by a horizontal partition 1*b*.

The pushbutton 3 is urged upwardly in conventional manner by a return spring 4 that is held at its bottom end in a cup 6 on the body of the lighter, and at its top end by a peg 5 inside the pushbutton 3. A vertical resilient latch given overall reference 7 is mounted inside the pushbutton, and is secured to the peg 5 by means of a ring 7*a*.

The latch 7 is constituted by a resilient part, e.g. made of plastics material, that is substantially in the form of an upside-down U-shape whose bottom portion can be opened or closed by an arm B having a projecting leading-end portion 9, and a trailing-end portion 10 constituting a safety catch. One of the branches 12 of the U-shape is held in place by two vertical ribs 14 provided inside the skirt 16. In the locked position, the catch 10 projects a little from the body of the lighter. It is slidable in a slot 13 defined by two internal ribs 20 on the lighter body that limit the down stroke of the skirt inside the lighter body. The portion 10 constitutes a depressible safety catch controlling the translation motion of the arm 8. On either side, the arm 8 also carries two pushbutton stops 11 that can be seen more clearly in FIG. 2 and that are engaged between the ribs 14 and the ribs 20 when in the locked position. The arm 8 is carried by the branch 12 of the latch 7, while the substantially vertical second branch 18 of the latch 7 has a hook 19 that retains the leading end 9 of the arm 8 in the "cocked" position.

An unhooking fork 17 is provided inside the body of the lighter, projecting up from the partition 1*b*, and at the end of the pushbutton down-stroke it comes into contact with the end of the arm 8 of the latch to release the end 9 of the arm 8 from the hook 19. The skirt 16 of the pushbutton 3 constitutes the portion thereof that penetrates into the body when the pushbutton is depressed.

The looking device operates as follows.

In the locked position shown in FIG. 1, the safety catch 10 projects from the body 1 of the lighter. The branch 12 of the latch 7 is substantially vertical (when the lighter is in the position shown in the figures). The end 9 of the arm 8 bears against the sloping face of the hook 19. Vertical pressure on the pushbutton 3 is opposed by contact between the two ribs 14 of the pushbutton, the two stops 11 of the latch 7, and the tops of the two ribs 20 on the body 1 of the lighter. The pushbutton cannot move, and gas cannot escape.

FIG. 3 shows the unlocked or "cocked" position. Depressing the catch 10 has caused the arm 8 to move in translation against the bending resilience of the branch 12. This motion brings the portion 9 into engagement with the hook 19 where it is retained. Simultaneously the stops 11 disengage: frown bearing surfaces on the ribs 14 and 20. In this position, the pushbutton 3 can be depressed to ignite the lighter, i.e. the lighter is then in its unlocked or "cocked" position.

As in an ordinary lighter, ignition is produced by the user pressing the thumb on the pushbutton, thereby causing the following to take place:

the pushbutton moves down inside the body of the lighter;

the gas-release valve is opened; and the arm 8 is released from the hook 19.

As the pushbutton moves downwards, the arm 8 is held in its inside position by being in engagement with the hook 19.

After ignition, the pushbutton 3 is released. The spring 4 returns the pushbutton 3 upwards away from the lighter body, thereby raising the latch 7. Because of its resilience, the branch 12 of the latch then pushes the arm 8 outwards and re-establishes the safety or locking state as shown in FIG. 1. The safety catch 10 again projects from the body 1. This locking prevents further ignition so long as the catch 10 has not been pressed back into the lighter. The lighter is thus easily operated with one hand in two movements that can be spaced apart in time to a greater or lesser extent. After ignition, the latch 7 automatically returns the lighter to its locked position.

Figure 4:
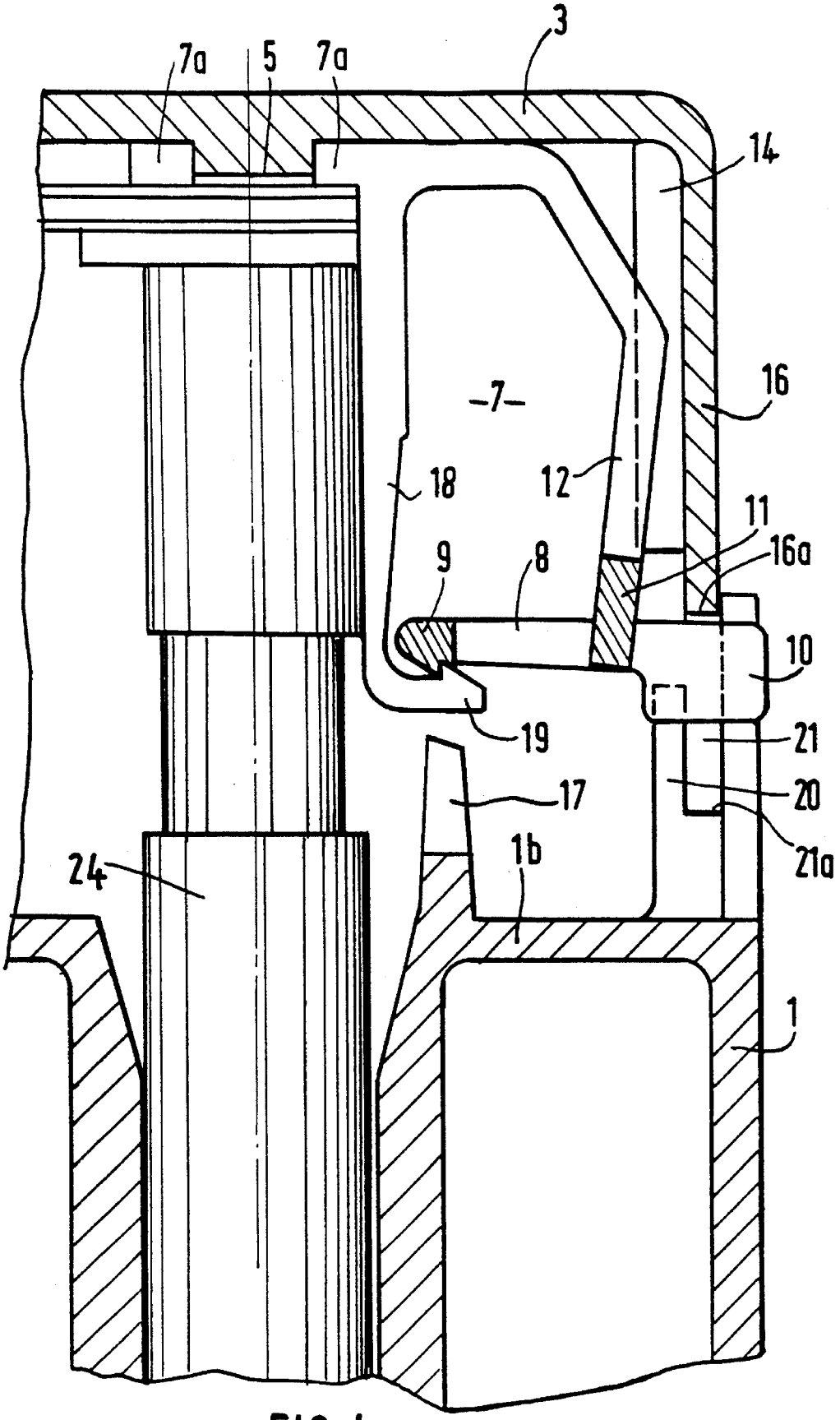
FIG. 4 is a view analogous to FIG. 3, applicable to piezoelectric ignition.

FIG. 4 shows an embodiment of the lighter that is more specifically adapted to piezoelectric ignition. In this figure, the lighter is in its "cocked" position. This figure shows elements as described above and given the same references, however it also shows a piezoelectric igniter 24 of conventional type that includes an internal spring (not shown) that provides the function of returning the pushbutton 3 to its high position. In order to increase the stroke of the pushbutton, the ribs 20 are provided with notches 21 of a width that is equal to or slightly greater than the width of the skirt 6 of the pushbutton so as to enable the skirt to penetrate into the notches. The height of the fork 17 has also been increased so that the hook is released only when the bottom portion 16*a* of the skirt 16 comes into abutment against the bottoms 21*b* of the notches 21.

Figure 5:
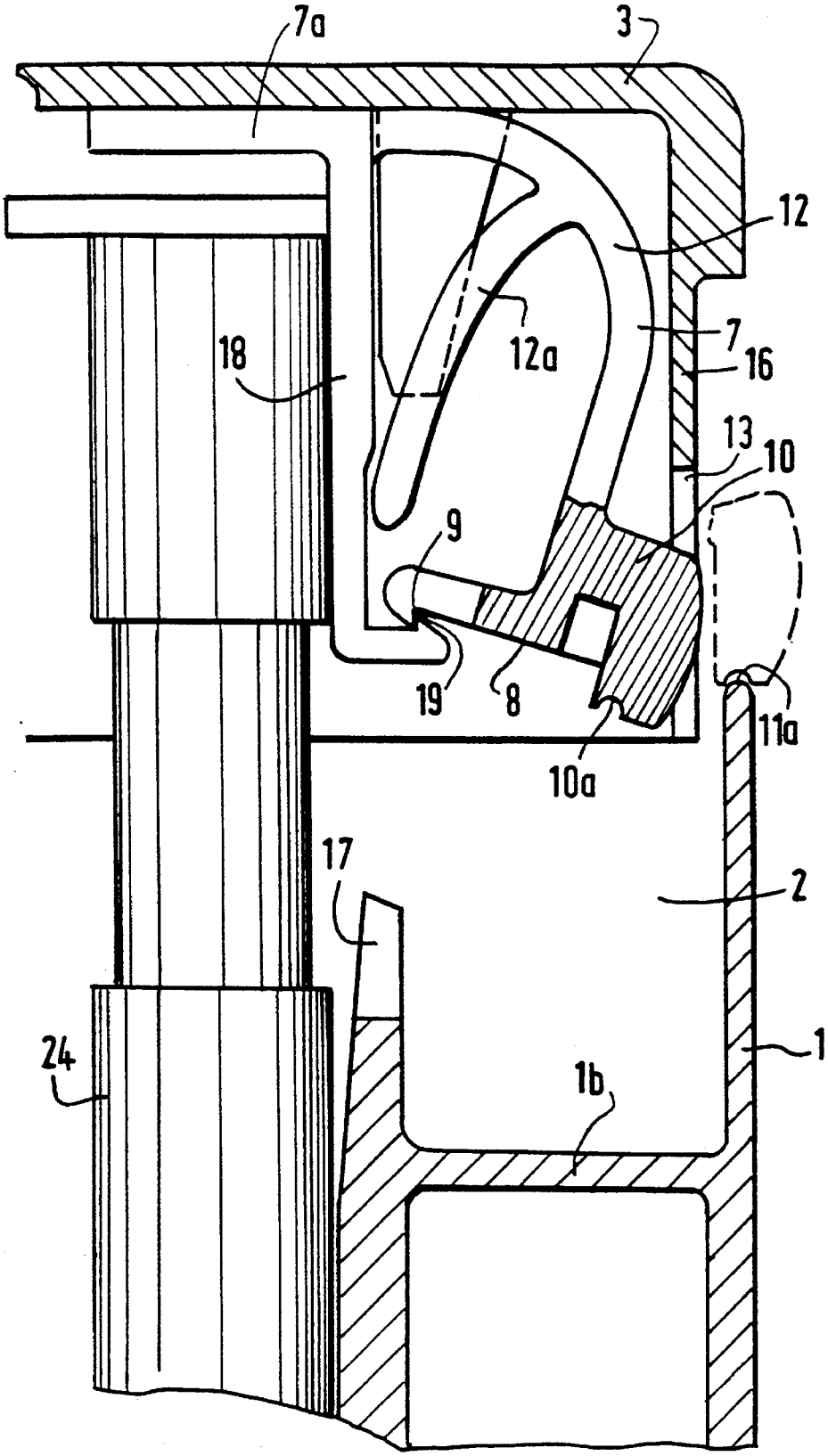
FIG. 5 is a vertical section view through the rear top portion of a lighter provided with a locking mechanism of the invention which is shown in the unlocked position.
Figure 5A:
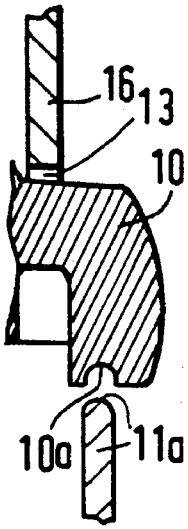
FIG. 5*a* is a detailed view showing how the pushbutton is blocked.

FIG. 5 and 5*a* show another embodiment making use of the same type of latch 7, the figure still being in the vertical position and the latch still being mounted beneath the pushbutton 3. In the embodiment shown, ignition is of the piezoelectric type.

The pushbutton 3 is urged upwards in conventional manner by the return spring included in the piezoelectric igniter assembly 24 and the tab 7*a* of the latch is carried by the top thereof. The tab 7*a* forms a portion of the resilient latch given overall reference 7. In this embodiment, there are no ribs 11 on the latch, nor are there any ribs 20 on the body of the lighter. However, the safety catch 10 is locked by coming into abutment against the top edge 11*a* of the lighter body, as shown in FIG. 5*a*.

As before, the rear portion 10 of the arm 8 is higher than the rest of the arm and constitutes the part of the safety catch that is pressed by the user. As shown by dashed lines in FIG. 5, when it is in the locked position the safety catch 10 has a groove 10*a* that engages and comes into abutment against the top portion 11*a* of the body. Pressing the rear portion 10 controls pivoting motion of the arm 8. The arm 8 is carried by the branch 12 of the latch 7. The vertical second branch 18 of the latch forms a hook 19 at its bottom end, which hook serves in the "cocked" position to retain the front end 9 of the arm 8. A third branch 12*a* of the latch serves to stiffen the branch 12 so as to avoid accidental unlocking. The disengagement fork 17 for disengaging the end 9 of the arm 8 from the hook 19 can be seen projecting from the surface 1*b*.

The skirt 16 of the pushbutton 3 constitutes the portion thereof that penetrates into the body when pressure is exerted on the pushbutton, and in this case it has a central slot 13*a* which is slightly wider than the width of the safety catch 10.

The locking device operates as follows:

In the locked position, the catch 10 is blocked by its groove 10*a* engaged on the edge 11*a* of the lighter body 1. The branch 12 of the latch is substantially vertical (when the lighter is in the position shown in the figures). The end 9 is in contact with the hook 19 but is not retained thereby. Vertical pressure applied to the pushbutton 3 is opposed by the catch 10 being in contact with the edge 11*a* of the lighter body 1 (FIG. 5*a*). The pushbutton cannot move and gas cannot escape.

FIG. 5 shows the unlocked or "cocked" position. By pressing in the catch 10, the user has caused the arm 8 to pivot by bending the branch 12. This motion brings the portion 9 into engagement with the hook 19 where it is retained. Simultaneously, the catch 10 pivots in the slot 13*a* so as to take up a retracted position. It penetrates inside the body 1 and escapes from the edge 11*a* of the lighter body 1. In this position the pushbutton 3 can be displaced downwards to ignite the lighter. The lighter is in its "cocked" or unlocked position.

As before, ignition takes place during the motion of the pushbutton and the latch is released by means of the form 17. After ignition, the pushbutton 3 is released. The spring of the piezoelectric igniter 24 returns the pushbutton upwards relative to the lighter. The rounded surface 10*b* of the catch 10 bears against the inside face 1*c* of the lighter body during the vertical upwards motion until said catch comes level with the edge 11*a*. The resilient portion 12 then pushes the arm 8 outwards. The groove 10*a* of the catch 10 snaps into the edge 11*a*. This blocking prevents further ignition until the catch 10 has again been pressed into the lighter. The lighter can thus easily be operated with one hand in two movements that may be spaced part to a greater or lesser extent. After ignition, the latch 7 automatically returns to the lighter to the locked position.

Naturally, numerous variants can be made, in particular by substituting equivalent technical means, without hereby going beyond the ambit of the invention.

That which is claimed is:

1. A safety latch for a lighter, comprising a lighter body having a lower reservoir section and an upper end forming a body cavity, said upper end including a reservoir valve for discharging gas from said lower reservoir section and a burner for igniting discharged gas, a pushbutton mounted at the upper end of the lighter body and vertically movable in the body cavity and operative with the reservoir valve and burner upon depression of said pushbutton for igniting discharged gas, said pushbutton having a split skirt forming a split opening, and a spring for applying an outward biasing force to said pushbutton, and a resilient latch received within said body cavity including a resilient latch piece mounted substantially in a plane of symmetry of the lighter body, and affixed to the pushbutton, said resilient latch piece having an inverted U-shape having a first branch and a second branch, each branch having an end wherein the end of the first branch includes a movable arm having opposing ends, and the end of the second branch is secured to said pushbutton, said movable arm having at one end a safety catch horizontally moveable through the split opening of the split skirt between a first position in which the catch projects outside to the lighter body when the lighter is in a locked position and a second position in which the catch moves into the body and the split skirt when the lighter is in an unlocked position, and wherein said arm includes stops for cooperating with the lighter body and engaging the split skirt and preventing depression of the pushbutton when the lighter is in its locked position.

2. A safety latch according to claim 1 wherein the second branch of the latch includes a hook, and wherein said arm carries a projection portion at its end opposite from the catch, wherein said projection portion cooperates with said hook carried by the second branch of the resilient latch.

3. A safety latch according to claim 1 including two longitudinal ribs formed inside the skirt and holding said first branch against lateral slipping, said pushbutton including a peg protruding inside the pushbutton, and including a tab surrounding said peg, said second branch being maintained on said peg protruding inside the pushbutton.

4. A safety latch according to claim 2 wherein the lighter body includes a fork positioned inside the said cavity, said fork enabling the projecting portion of the arm to be disengaged from the hook means when the pushbutton is depressed.

5. A safety latch according to claim 1 wherein the lighter body includes ribs disposed at either side of the split skirt beneath the ribs of the pushbutton for engaging the stops when the latch is in the locked position.

6. A safety latch device according to claim 5 wherein the ribs inside said lighter body have notches of width substantially equal to the width of the said split skirt.

7. A safety latch according to claim 1 wherein the split opening of the split skirt has a width substantially equal to the width of the catch.

8. A safety latch according to claim 1 wherein said latch has a third branch to stiffen said first branch.

9. A safety latch according to claim 1 wherein in a locked position the catch comes into abutment against a rear top edge of said lighter body, and the end of the arm that bears against the hook means is carried by the second branch of said resilient latch piece.

10. A locking mechanism for the pushbutton of a lighter including a main body having a reservoir for holding a combustible fluid under pressure and an upper body portion comprising a valve mounted at the upper portion of said body and communicating with said reservoir for releasing fluid in a gaseous state, said valve being normally closed, an igniter for igniting any released gas, a valve actuator including a pushbutton piece operatively engaged with said valve for releasing gaseous fluid when said pushbutton is depressed along a longitudinal axis of said body, said pushbutton piece having a skirt and in said skirt a split opening forming a central slot, means positioned between said pushbutton on said body for normally preventing said pushbutton to be depressed along the longitudinal axis of said body thereby maintaining said pushbutton in a locked position, spring means for applying an outward biasing force to said pushbutton, a rigid arm extending through said skirt slot and being moveable in a direction perpendicular to said longitudinal axis of said body, said arm having a forward end slidable from a position outside said body to a position within said body after said forward end of said arm is depressed, and at least one stop mounted on said arm adjacent said forward end for engaging the skirt of said pushbutton, said arm also including a rearward end opposite said forward end and including a hook for hooking and maintaining said arm in a depressed condition after said arm is depressed for allowing the skirt of the pushbutton to slide within said body, said arm being affixed on an inverted U-shaped resilient latch piece inside the upper body portion.

* * * * *

UNITED STATES PATENT AND TRADEMARK OFFICE

CERTIFICATE OF CORRECTION

PATENT NO. : 5,558,514

DATED : September 24, 1996

INVENTOR(S) : Henri Ansquer

It is certified that error appears in the above-indentified patent and that said Letters Patent is hereby corrected as shown below:

Column 3, line 22, delete the word "frown" and insert therefor the word – from –.

Signed and Sealed this

Twenty-fourth Day of December, 1996

*Attest:*

Bruce Lehman

BRUCE LEHMAN

*Attesting Officer*

*Commissioner of Patents and Trademarks*